US011912524B2

(12) United States Patent
Convert et al.

(10) Patent No.: US 11,912,524 B2
(45) Date of Patent: Feb. 27, 2024

(54) SEPARATOR FOR THE TRANSIENT RECEPTION OF SHEET ELEMENTS BETWEEN A LIFTING TABLE AND AN OUTPUT CONVEYOR FOR BUNDLES OF ELEMENTS

(71) Applicant: Bobst Lyon, Villeurbanne (FR)

(72) Inventors: Claude Convert, Beynost (FR); Guillaume Perron, Villeurbanne (FR)

(73) Assignee: BOBST LYON, Villeurbanne (FR)

( * ) Notice: Subject to any disclaimer, the term of this patent is extended or adjusted under 35 U.S.C. 154(b) by 226 days.

(21) Appl. No.: 17/310,410

(22) PCT Filed: Feb. 25, 2020

(86) PCT No.: PCT/EP2020/025090
§ 371 (c)(1),
(2) Date: Jul. 30, 2021

(87) PCT Pub. No.: WO2020/173606
PCT Pub. Date: Sep. 3, 2020

(65) Prior Publication Data

US 2022/0089399 A1 Mar. 24, 2022

(30) Foreign Application Priority Data

Feb. 26, 2019 (FR) ..... 1901939

(51) Int. Cl.
*B65H 31/32* (2006.01)
*B65H 31/10* (2006.01)
(Continued)

(52) U.S. Cl.
CPC ..... *B65H 31/10* (2013.01); *B65H 31/20* (2013.01); *B65H 31/3054* (2013.01);
(Continued)

(58) Field of Classification Search
CPC ..... B65H 31/32
See application file for complete search history.

(56) References Cited

U.S. PATENT DOCUMENTS 5,545,001 A 8/1996 Capdeboscq
5,882,175 A 3/1999 Villacieros Fernandez
(Continued)

FOREIGN PATENT DOCUMENTS

CN 1323691 A 11/2001
CN 103287904 A 9/2013
(Continued)

OTHER PUBLICATIONS

International Search Report dated Jun. 2, 2020 in counterpart International Patent Application No. PCT /EP2020/025090 (2 pages in English, 2 pages in French).

*Primary Examiner* — Lynn E Schwenning
(74) *Attorney, Agent, or Firm* — Bookoff McAndrews, PLLC

(57) ABSTRACT

A separator (1) for temporarily receiving sheet elements (9) that are to be transferred from a stacking table (2) to an output conveyor (3) of bundles of sheet elements comprises:

- a support (10) mounted with the ability to slide in a vertical direction;
- a drive device (11) for driving the support in the vertical direction;
- several arms (13) extending in a longitudinal horizontal direction, spaced apart in a transverse direction, at least one arm (13) being mounted with the ability to move in the longitudinal horizontal direction with respect to the support, the movement of the arm modifying its overhanging length with respect to the support (10) on a first side in the longitudinal horizontal direction;
- a drive system (12) configured to simultaneously move the arm in the longitudinal horizontal direction and to keep another of the arms in its longitudinal position.

20 Claims, 16 Drawing Sheets

(51) Int. Cl.
*B65H 31/20* (2006.01)
*B65H 31/30* (2006.01)

(52) U.S. Cl.
CPC ..... *B65H 31/32* (2013.01); *B65H 2403/41* (2013.01); *B65H 2405/323* (2013.01); *B65H 2405/324* (2013.01); *B65H 2511/12* (2013.01)

(56) References Cited

U.S. PATENT DOCUMENTS

| | | | | |
|---|---|---|---|---|
| 7,402,130 | B1 | 7/2008 | Sjostedt et al. | |
| 9,481,541 | B2 * | 11/2016 | Cugnoni | B65H 31/32 |
| 10,906,186 | B2 * | 2/2021 | Takahashi | B25J 15/0616 |
| 2001/0053393 | A1 | 12/2001 | Baumann et al. | |
| 2013/0140763 | A1 | 6/2013 | Jakob | |
| 2015/0050113 | A1 | 2/2015 | Cugnoni | |

FOREIGN PATENT DOCUMENTS

| | | | | | |
|---|---|---|---|---|---|
| CN | 104334483 | A | | 2/2015 | |
| EP | 0501213 | A1 | | 9/1992 | |
| EP | 0666234 | A1 | | 8/1995 | |
| EP | 2149522 | A2 | | 2/2010 | |
| JP | S 48-2675 | | * | 1/1973 | |
| JP | H 03115056 | A | * | 5/1991 | B21D 43/22 |
| JP | H03115056 | A | | 5/1991 | |
| JP | 2015516319 | A | | 6/2015 | |

* cited by examiner

SEPARATOR FOR THE TRANSIENT RECEPTION OF SHEET ELEMENTS BETWEEN A LIFTING TABLE AND AN OUTPUT CONVEYOR FOR BUNDLES OF ELEMENTS

CROSS-REFERENCE TO RELATED APPLICATION(S)

This application is a National Stage under 35 U.S.C. § 371 of International Application No. PCT/EP2020/025090, filed on Feb. 25, 2020, which claims priority to French Patent Application No. 1901939, filed on Feb. 26, 2019, the contents of all of which are incorporated by reference in their entirety.

The invention relates to the formation of bundles of sheet elements, at the output of a line for printing or converting such sheet elements, notably for the manufacture of packaging. The invention relates in particular to equipment intended to transfer bundles of sheet elements to a bundles output conveyor, avoiding the interruptions of bundle formation cycles.

After having undergone various printing or conversion operations, sheet elements need to be stacked in bundles of a predefined number and with the sheet elements accurately positioned relative to one another. It is therefore known practice to employ, downstream of the conversion machines, a sheet-element counting station, a station for stacking the sheet elements on a stacking table, and a system for transferring a stack to an output conveyor to separate the stacks.

A free-fall stacking station includes a stacking table. A device allows the sheet elements to fall sequentially onto the stacking table, to form a stack. The stacking table descends at the rate at which the stack grows. Once the number of sheet elements that correspond to a bundle is reached, there then arises the problem of correctly discharging this bundle without interrupting the sheet-element feed cycle.

PRIOR ART

Document EP 0501213 describes a station for stacking, separating and discharging bundles of sheet elements. The station comprises means for feeding the sheet elements, retractable supports that form a temporary stacking magazine, placed above a bundle discharge device.

Such a station has its disadvantages. In particular, the first sheet element to arrive in the stacking magazine will be in contact with, and damaged by, the retractable supports. In addition, because of the fixed-height position of the retractable supports, the temporary stacking magazine will become more quickly saturated with sheet elements arriving at a high rate, and this limits the overall productivity of the printing or conversion line.

Document EP 0666234 describes a station for stacking, separating and discharging bundles of sheet elements. The station comprises a stacking table able to move vertically, receiving sheet elements falling onto it to be stacked. The table descends progressively down to the level of an output conveyor, collecting and discharging a bundle of sheet elements after this bundle has been formed. A separator moves vertically and horizontally. After a bundle has been formed, the separator is positioned vertically over the stacking table and interposes itself to support the sheet elements of the next bundle. The stacking table then transfers the bundle that has just been formed, to the output conveyor which discharges the bundle. The separator is then retracted and the stacking table can then collect the sheet elements of the next bundle.

Such a station has its disadvantages. In particular, the separator exhibits a certain inertia. It is difficult to move it during a cycle at a speed compatible with the stacking rates required for the sheet elements. Such a separator may also prove to be incompatible with certain modes of transverse alignment of the sheet elements.

SUMMARY OF THE INVENTION

The invention seeks to solve one or more of these drawbacks. The invention thus relates to a separator for temporarily receiving sheet elements that are to be transferred from a stacking table to an output conveyor of bundles of sheet elements, comprising:

- a support mounted with the ability to slide in a vertical direction;
- a drive device for driving the support in the vertical direction;
- several arms extending in a longitudinal horizontal direction, spaced apart in a transverse direction, at least one arm being mounted with the ability to move in the longitudinal horizontal direction with respect to the support, the movement of the arm modifying its overhanging length with respect to the support on a first side in the longitudinal horizontal direction;
- a drive system configured to simultaneously move the arm in the longitudinal horizontal direction and to keep another of the arms in its longitudinal position.

The invention also relates to the following variants. A person skilled in the art will understand that each of the features of the following variants can be combined independently with the above features, without in any way constituting an intermediate generalization.

According to one variant, the drive system includes:

- a shaft, deploying in the transverse direction and driven in rotation;
- a pinion for each arm, rotating as one with the shaft;
- a rack secured to the arm;
- a clutch-forming device configured to selectively couple and uncouple the pinion with respect to the rack.

According to another variant, the clutch-forming device of each arm includes an actuator configured to move the pinion associated with the arm translationally along the axis of the shaft in order to selectively engage or disengage the rack with respect to the arm.

According to yet another variant, each of the actuators drives a lock bolt immobilizing the translational sliding of the associated arm during the disengagement of the pinion associated with the arm.

According to yet another variant, the pinion is coupled to the shaft via a key.

According to one variant, the arm comprises a slider collaborating with a slideway secured to the support, so as to guide the movement of the arm in the longitudinal horizontal direction.

According to yet another variant, the arms are arranged at the one same vertical level with respect to the support.

According to another variant, the arms are mounted with the ability to slide with respect to the support so as to be able to reach an overhanging length to hold a bundle of sheet elements with respect to the support on the said first side.

According to yet another variant, the arms are spaced apart in the transverse direction by a distance corresponding to a separation between endless conveyor belts of a stacking table.

According to yet another variant, the separator includes a control unit configured to control, sequentially:

the sliding of the support downwards;

the moving of several of the arms into a deployed position with overhang with respect to the first side;

the placing of all of the arms in a retracted position with respect to the first side;

the sliding of the support upwards.

According to yet another variant, the control unit is configured to control the downward sliding of the support in a succession of sliding steps and stoppages.

The invention also relates to a station for receiving sheet elements and for discharging bundles of sheet elements for a machine for manufacturing packaging, comprising a separator as described hereinabove.

BRIEF DESCRIPTION OF THE DRAWINGS

Further features and advantages of the invention will become clearly apparent from the description thereof given hereinafter by way of nonlimiting indication, with reference to the attached drawings in which.

The longitudinal direction is defined with reference to the direction of travel or of drive of the sheet elements through the packaging manufacturing machine, through the sheet-element receiving station, along their median longitudinal axis. The transverse direction is defined as being the direction perpendicular, in a horizontal plane, to the direction of travel of the sheet elements. The upstream and downstream directions are defined with reference to the direction of travel of the sheet elements in the longitudinal direction throughout the entire packaging manufacturing machine, from entering the machine to exiting the machine and the sheet element receiving station.

DETAILED DESCRIPTION OF PREFERRED EMBODIMENTS

Figure 1:
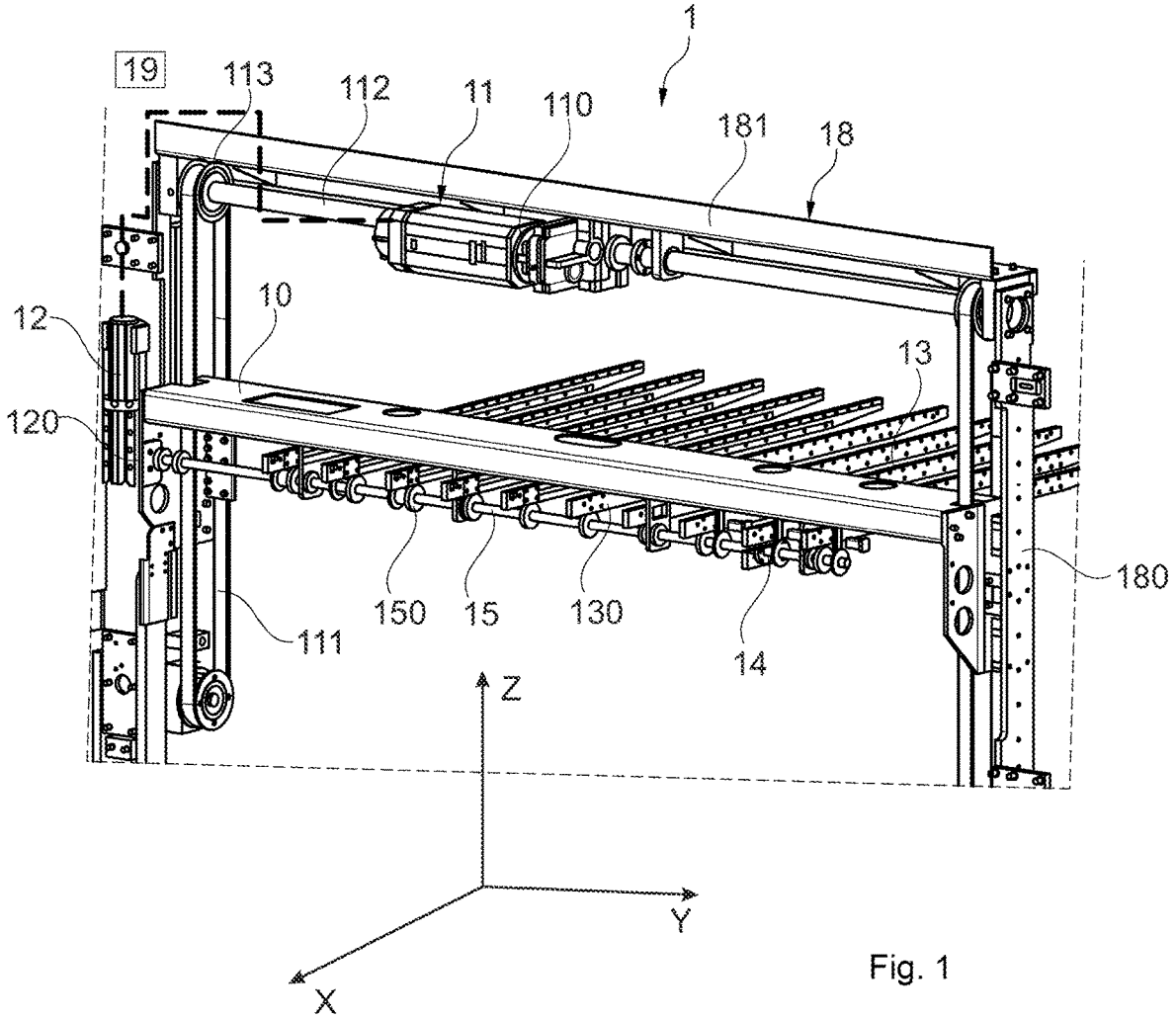
FIG. 1 and FIG. 2 are perspective views of an example of a separator according to one embodiment of the invention.
Figure 2:
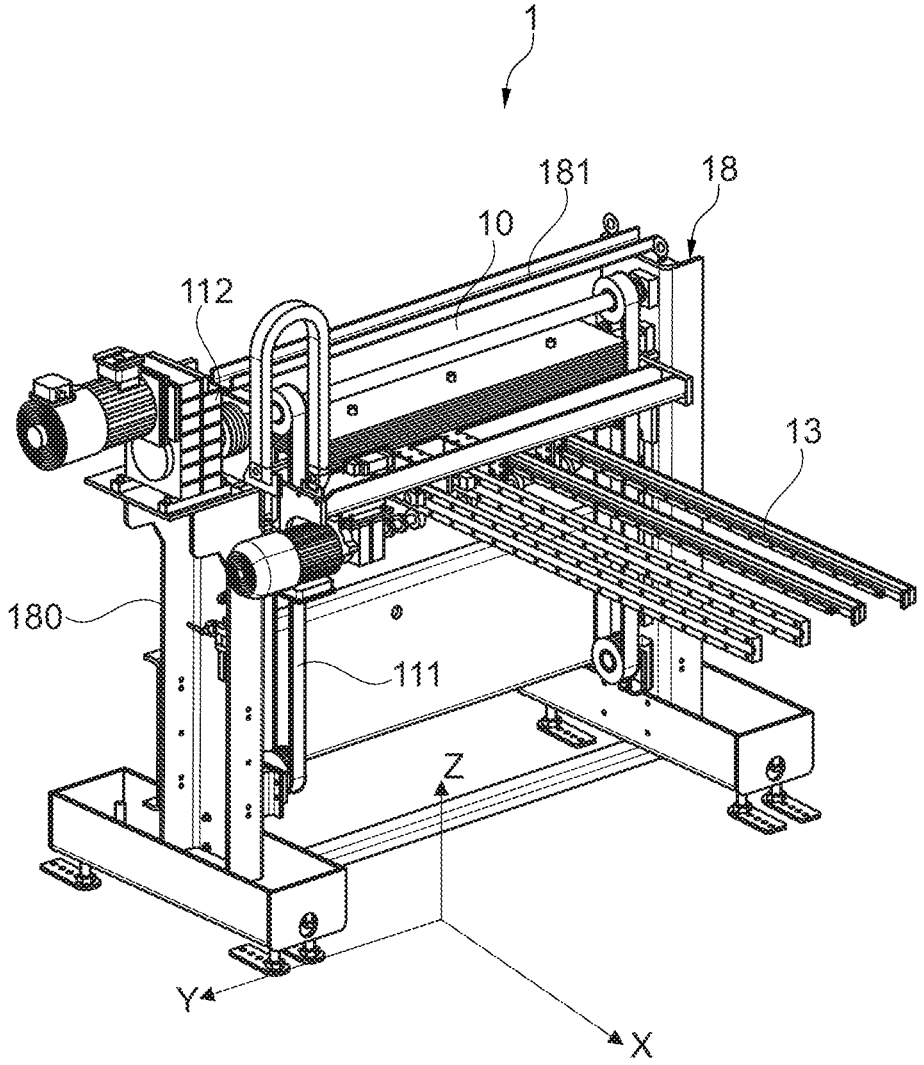

FIGS. 1 and 2 are perspective views of one example of a separator 1 according to one embodiment of the invention. The separator 1 is intended to temporarily receive sheet elements that are to be transferred from a stacking table to an output conveyor of bundles of such sheet elements (which are detailed hereinafter). The separator 1 may thus be included in a station for receiving sheet elements and for discharging bundles of such elements, for example for a machine for manufacturing packaging.

The separator 1 comprises a chassis 18, a support 10, a drive device 11, a drive system 12, arms 13 and a control unit 19.

The support 10 is mounted with the ability to slide with respect to the chassis 18 in a vertical direction. The chassis 18 comprises two vertical uprights 180 (direction Z illustrated) and one crossmember 181 oriented transversely and connecting the vertical uprights 180. The support 10 may be guided in vertical sliding in a way known per se by vertical rails that may be formed in the uprights 180. The support 10 forms a beam that is elongate in a transverse direction (direction Y illustrated). The transverse direction is horizontal and perpendicular to the direction (direction X) of transport of the sheet elements reaching the separator 1. The drive device 11 is configured to drive the support 10 in the vertical direction. The drive device 11 here includes a geared electric motor 110 controlled by the control unit 19, and belts 111 engaged with a rotor of the geared motor 110 via a shaft 112, on the one hand, and engaged with the support 10 secured to a fixed point on each of the belts 111. The belts 111 are guided by notched pulleys 113. The motor here is fixed to the crossmember 181.

Arms 13 extend in the longitudinal horizontal direction and are spaced apart in the transverse direction. The arms 13 are mounted on the support 10 in such a way as to be guided in their movements in the longitudinal horizontal direction. The movement of each of the arms 13 modifies its overhanging length with respect to the support 10, particularly on a first side with respect to the support 10 in this horizontal direction. The overhang of the arms 13 with respect to the support 10 may for example be measured with respect to a plane including the directions Y and Z and positioned at one longitudinal end of this support 10. In a retracted position, the arms 13 are positioned on a second side with respect to the support 10 and have a minimum or zero amount of overhang on the first side with respect to the support 10.

The drive system 12 is configured to simultaneously move one or more arms 13 in the longitudinal horizontal direction and to keep one or more other arms 13 in their longitudinal position. The drive system 12 here includes a shaft 15 deploying in the transverse direction and guided in rotation by the support 10, for example via various bearings and ball bearings which are not detailed. The drive system 12 further comprises a geared electric motor 120 driving the shaft 15 in rotation. For each of the arms 13, the drive system 12 further comprises a respective toothed pinion 150. Each of the pinions 150 rotates as one with the shaft 15. For each of the arms 13, the drive system 12 also comprises a rack 130 secured to this arm 13. The drive system 12 further comprises a clutch-forming device 14 (detailed hereinafter) configured to selectively couple and uncouple a pinion 150 and a rack 130.

Figure 3:
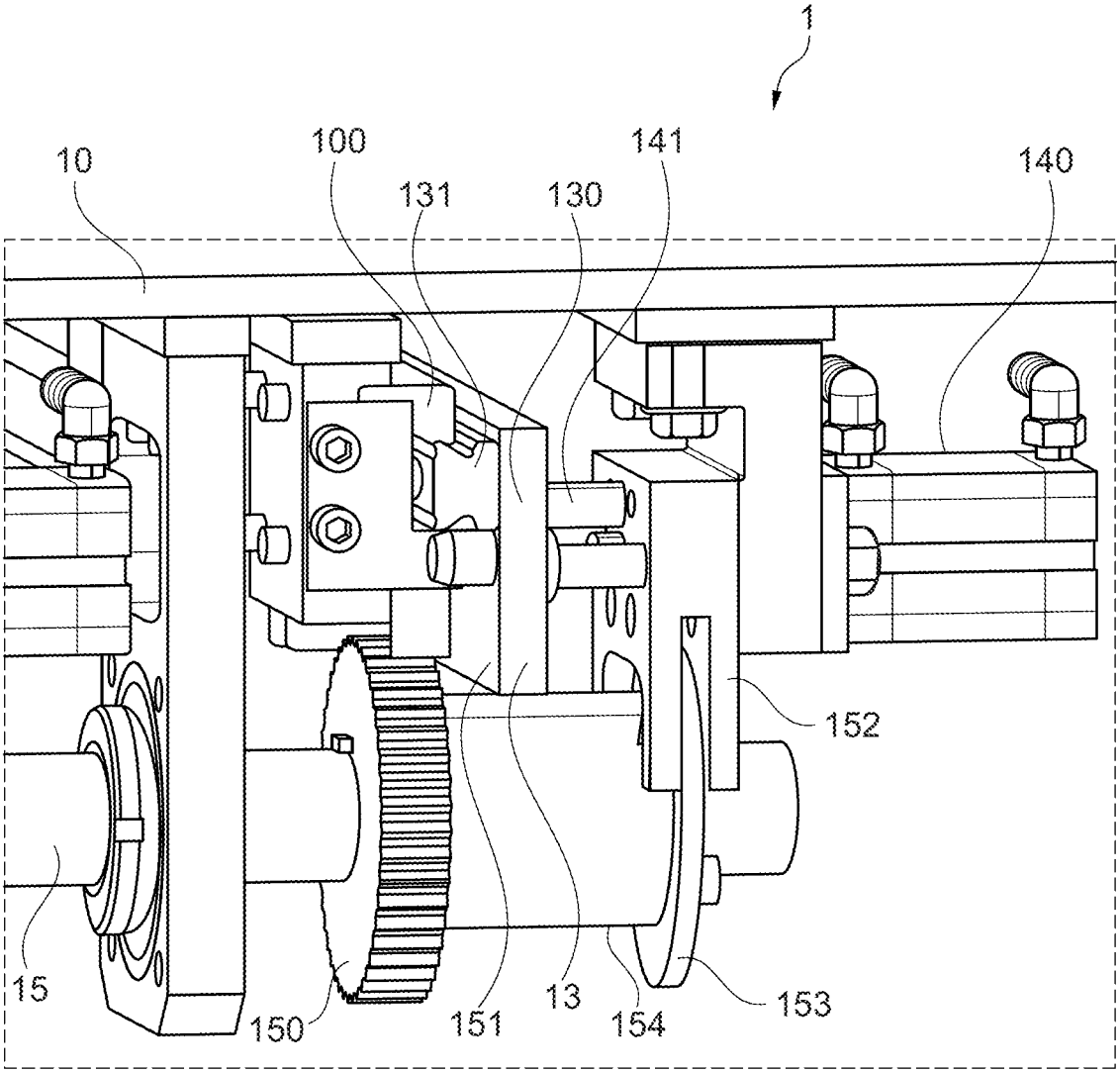
FIG. 3 is a perspective view of the separator in the region of a drive system and of a clutch device for an arm.
Figure 4:
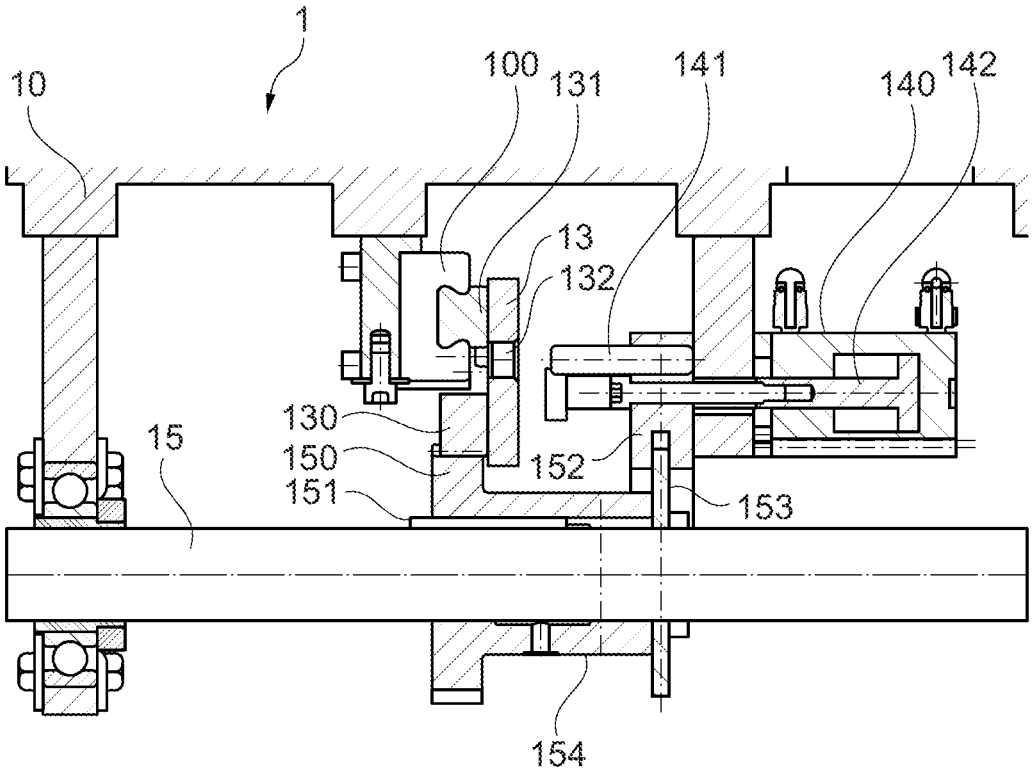
FIG. 4 is a view in section of the separator at an axis of the drive system.

FIG. 3 is a perspective view of the separator 1 at the region of the drive system 12 and of a clutch-forming device 14 for an arm 13. FIG. 4 is a view in section at the drive system 12 and at this clutch-forming device 14.

The arm 13 here comprises a slider 131. The slider 131 collaborates with a slideway 100 of the support 10, so as to guide the movement of the arm 13 in the longitudinal horizontal direction.

As illustrated in FIG. 4, the pinion 150 is mounted with the ability to slide in the transverse direction (corresponding to the direction of the axis of rotation of the shaft 15) with respect to the shaft 15. In order also to be driven in rotation by the shaft 15, the pinion 150 is coupled to the shaft 15 using a key 151. The pinion 150 is thus able to move between two transverse positions: the position illustrated in FIG. 4 in which it is engaged with the rack 130 of an arm 13, and a position that is further offset towards the left, in which it is uncoupled from the rack 130.

The clutch-forming device 14 of each arm 13 here includes an actuator 140. The body of the actuator 140 is fixed to the support 10. The actuator 140 is controlled by the control unit 19 so as to move its piston 142 in the transverse direction. The piston 142 is able to move the pinion 150 axially. A flange 153 is thus fixed to one end of a bushing 154 of one piece with the pinion 150 and coaxial with the pinion and with the shaft 15. The flange 153 is engaged with a fork 152 which is fixed at the free end of the piston 142. The flange 153 is thus driven in sliding by the piston 142 in the transverse direction. In this way, the movement of the piston 142 selectively allows the pinion 150 to be coupled or uncoupled with respect to the rack 130. When the pinion 150 is uncoupled or disengaged from the rack 130, the rotation of the shaft 15 does not drive a translational movement of the arm 13.

Advantageously, the separator 1 comprises a locking mechanism allowing an arm 13 to be immobilized in terms of translation when this arm is not being driven by the device 12. Thus, a pin 141 projects out in a transverse direction from the flange 152. The pin 141 is positioned facing a bore 132 formed in the arm 13. Upon a movement of the piston 142 uncoupling or disengaging the pinion 150 and the rack 130, the pin is driven until it becomes lodged in the bore 132. The pin 141 thus allows the arm 13 to be immobilized in terms of translation.

The longitudinal movement of the arms 13 is used to form a temporary support for the sheet elements. The arms 13 are thus deployed to form a receiving grating, so as to temporarily receive the sheet elements in the form of bundles, the arms 13 being arranged in such a way as to be able to cross (without interfering with) the endless conveyor belts of a stacking table in the vertical direction. The inertia in the movement of such arms 13 is markedly lower than the inertia of the entire separator 1 should it be necessary to move that.

In order to be able to form a support for a bundle of sheet elements, the arms 13 are mounted with the ability to slide with respect to the support 10 so as to be able to achieve an overhanging length that makes it possible to hold a bundle of sheet elements with respect to the support 10, on a side corresponding to the arrival of these sheet elements. In order to be able to form an optimum support for a bundle of sheet elements resting on the arms 13, these arms 13 are advantageously all arranged at the one same vertical level with respect to the support 10.

The arms 13 are spaced apart in the transverse direction by a distance corresponding to a separation between endless conveyor belts of a stacking table detailed later. The arms 13 may thus criss-cross such conveyor belts.

The control unit 19 is configured to control the drive device 11 in such a way as to position the support 10 at a suitable vertical position. The control unit 19 is also configured to select which arms are to be moved towards a stacking table and which arms are to be kept in the retracted position with respect to the stacking table.

Figure 5:
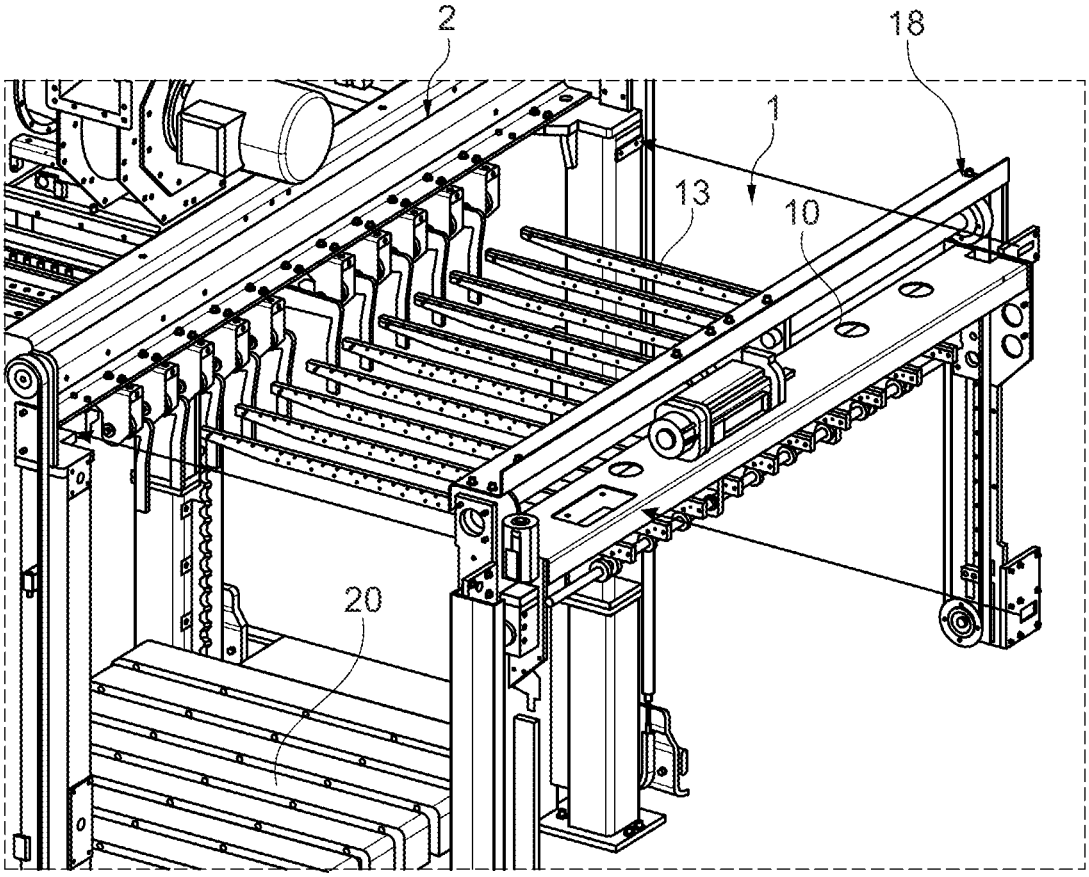
FIG. 5 is an exploded perspective view of the separator associated with a stacking table.
Figure 6:
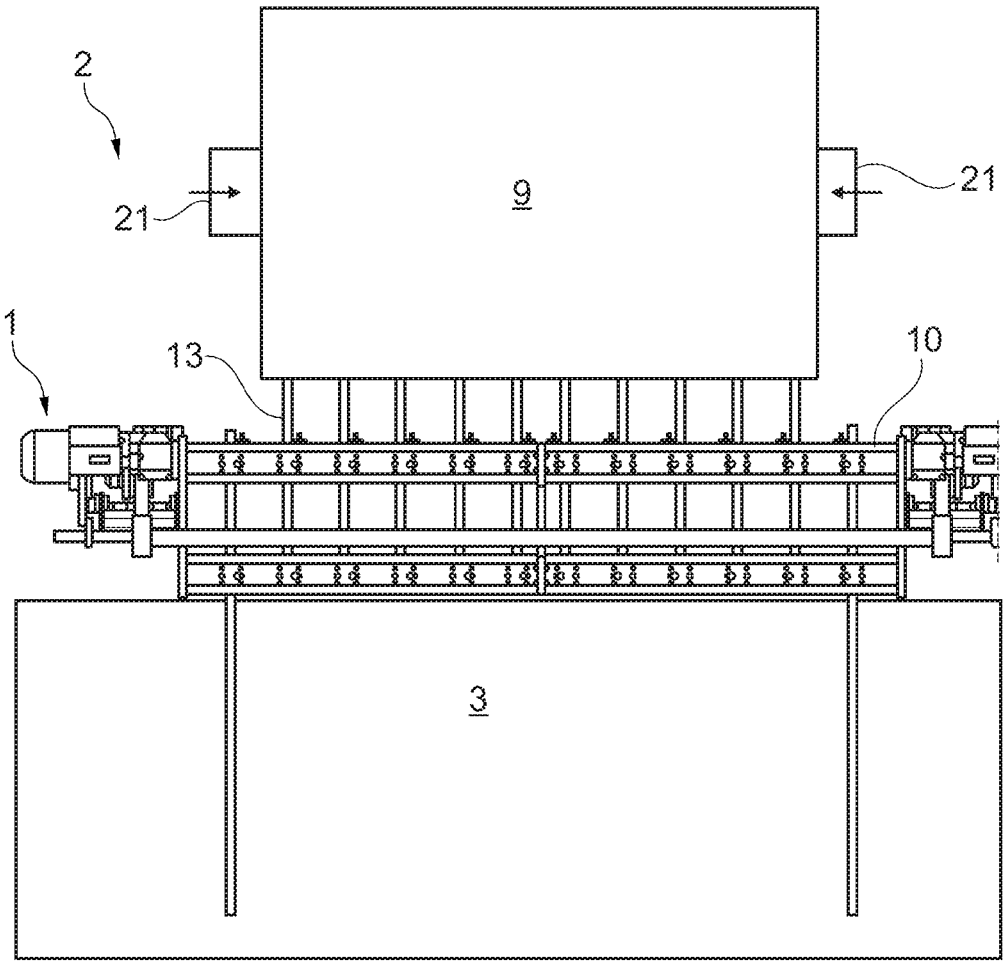
FIG. 6 is a view from above of a combination of a stacking table and of the separator.
Figure 7:
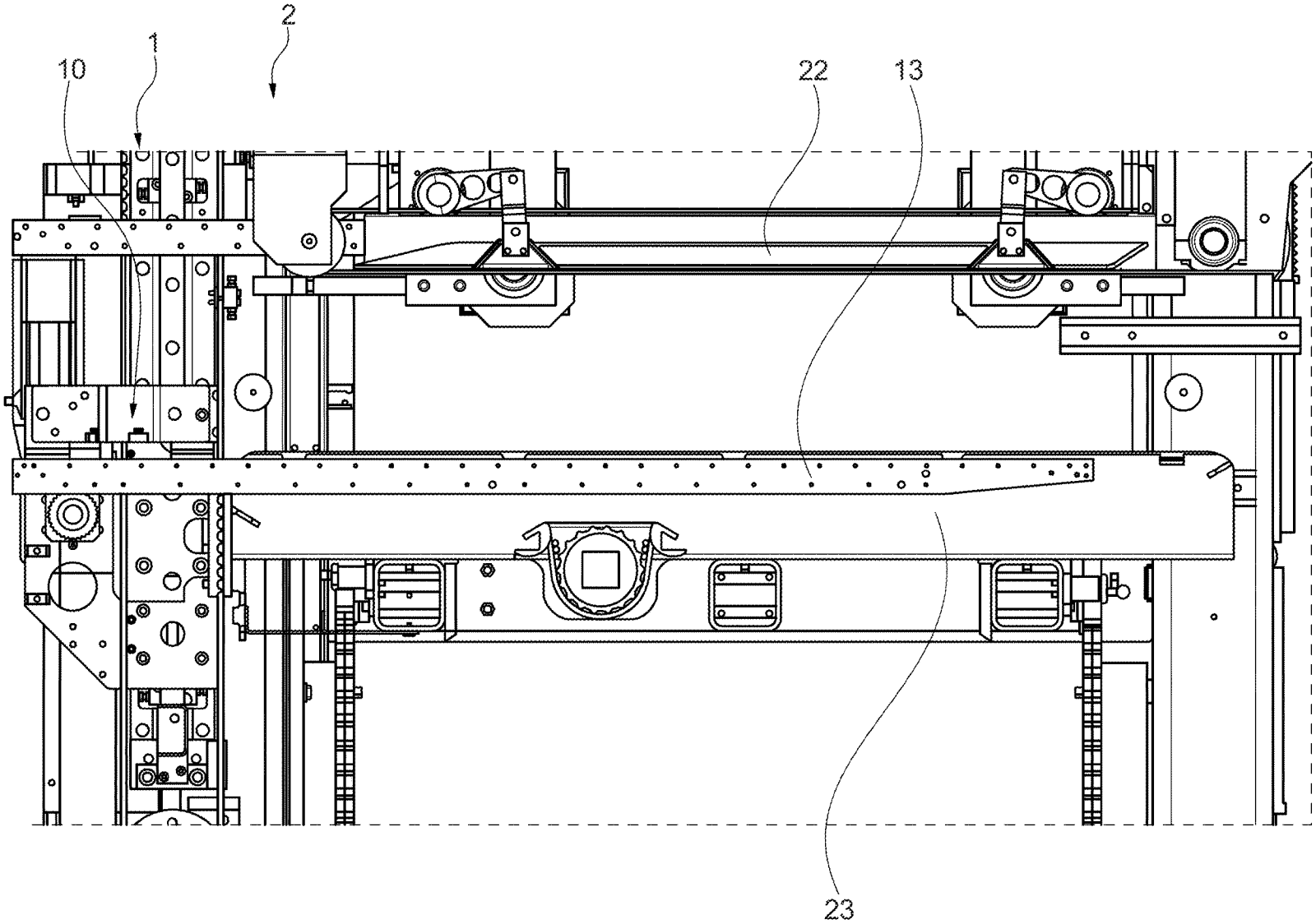
FIG. 7 is a side view in section of the combination of the stacking table and of the separator.
Figure 8:
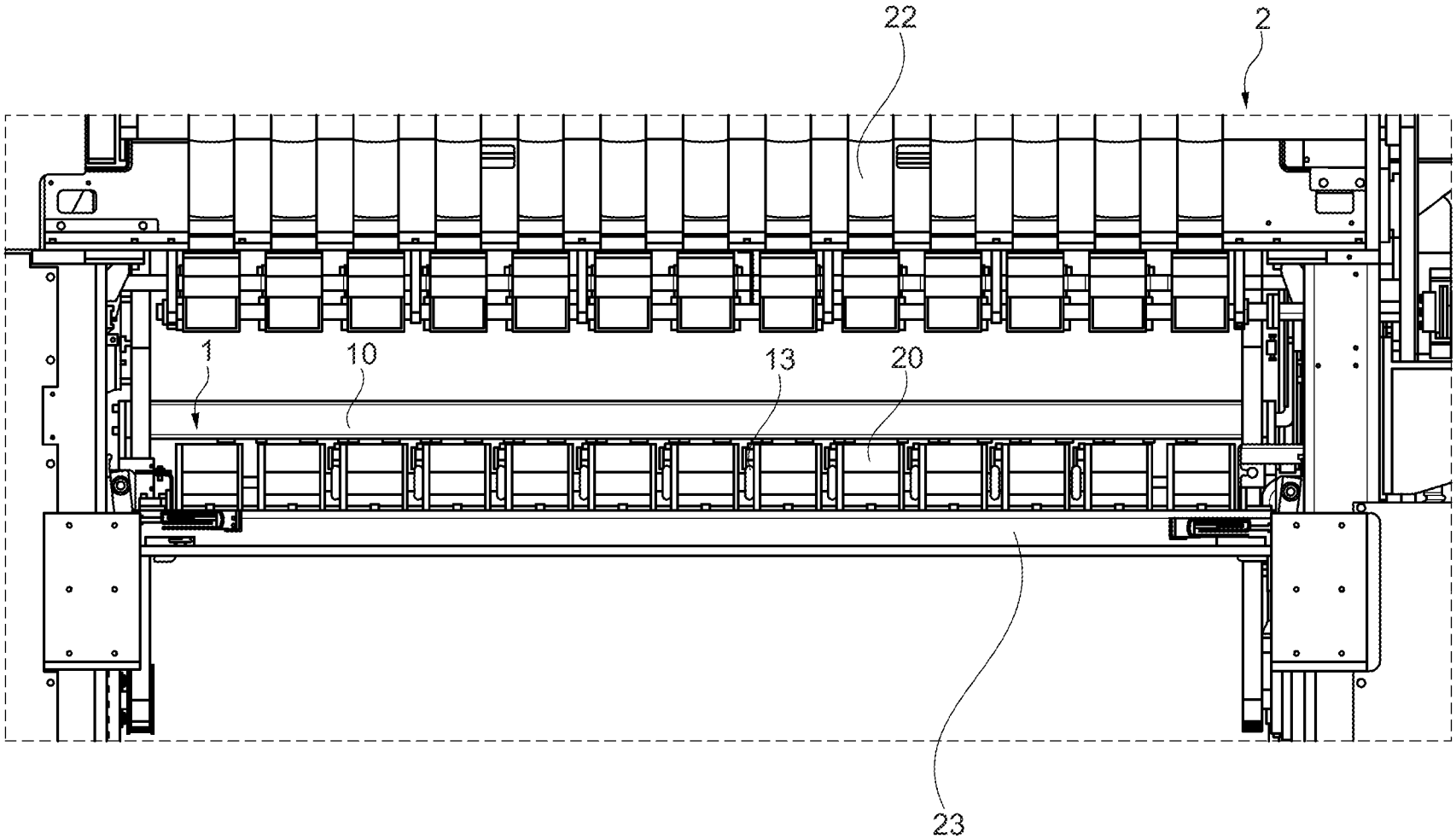
FIG. 8 is a face-on view of the combination of the stacking table and of the separator.

FIG. 5 is an exploded perspective view of the combination of the separator 1 with a stacking table 2. FIG. 6 is a view from above of a combination of the stacking table 2 and of the separator 1. FIG. 7 is a side view in section of the combination of the stacking table 2 and of the separator 1. FIG. 8 is a front-on view of the combination of the stacking table 2 and of the separator 1.

The chassis 18 of the separator 1 is fixed to a chassis of the stacking table 2. The stacking table 2 comprises endless conveyor belts 20 mounted on a support 23. These endless conveyor belts 20 are configured to be able to drive sheet elements translationally in the longitudinal direction common to the longitudinal direction of the separator 1. In FIG. 5, all the arms 13 are overhanging on the side of the stacking table 2. In FIG. 7, it is possible to make out a sheet elements suction device 22 configured to selectively hold or release a sheet element. The sheet element then falls under the effect of gravity either onto the arms 13 of the separation 1 or onto the endless conveyor belts 20 of the stacking table 2.

In FIG. 6 only certain arms 13 have been deployed on the side of the stacking table 2. Other arms 13 have been kept in retracted position. In this instance it is the arms 13 positioned at the transverse ends of the support 10 which are kept in the retracted position. The arms 13 in the retracted position are, here, vertically in line with an output conveyor 3 for bundles of sheet elements. Sheet elements 9 have been deposited on the deployed arms 13 on the side of the stacking table 2.

The station for receiving sheet elements comprises knocking-up buffers or joggers 21, arranged transversely on each side of the sheet elements 9. By vibrating, the joggers 21 allow the transverse position of the sheet elements 9 to be fixed so as to form a bundle 90 with well-aligned elements 9. The main function of engaging and disengaging the arms is so as not to select the arms that are outside of the width and which would therefore strike the lateral joggers 21. The arms 13 in the retracted position make it possible to avoid any risk of colliding with such joggers 21.

Such a separator 1 also allows the arms 13 to be disengaged or engaged selectively, making it possible to deploy only the necessary number of arms 13 to receive the sheet elements of a given width. The inertia in the driving of the arms 13 can thus be reduced, for a separator 1 having to execute cycles of a short duration. Furthermore, keeping a certain number of arms 13 in the retracted position makes it possible to reduce the turning moment about the transverse axis for the support 10.

FIG. 8 is a face-on view of the combination of the stacking table 2 and of the separator 1. Here, the arms 13 of the separator 1 are at the same level as the endless conveyor belts 20. The deployed arms 13 are interposed between endless conveyor belts 20.

The stacking table 2 and the separator 1 can be combined downstream of means for feeding sheet elements 9 successively one after the other.

FIGS. 9 to 16 illustrate the kinematics of the separator 1 during various phases in its operation, in collaboration with the stacking table 2 and the conveyor 3. In order to implement such kinematics, the control unit 19 is configured to command sequentially:

- the sliding of the support 10 downwards;
- the moving of several or of all of the arms 13 into a deployed position overhanging a first side with respect to the support 10 and, if necessary, the corresponding keeping of at least one arm 13 in a retracted position with respect to this first side;
- the placing of all of the arms 13 in a retracted position with respect to the first side;
- the sliding of the support 10 upwards.

Advantageously, the control unit 19 controls the downward sliding of the support 10 in a succession of sliding steps and stoppages.

Figure 9:
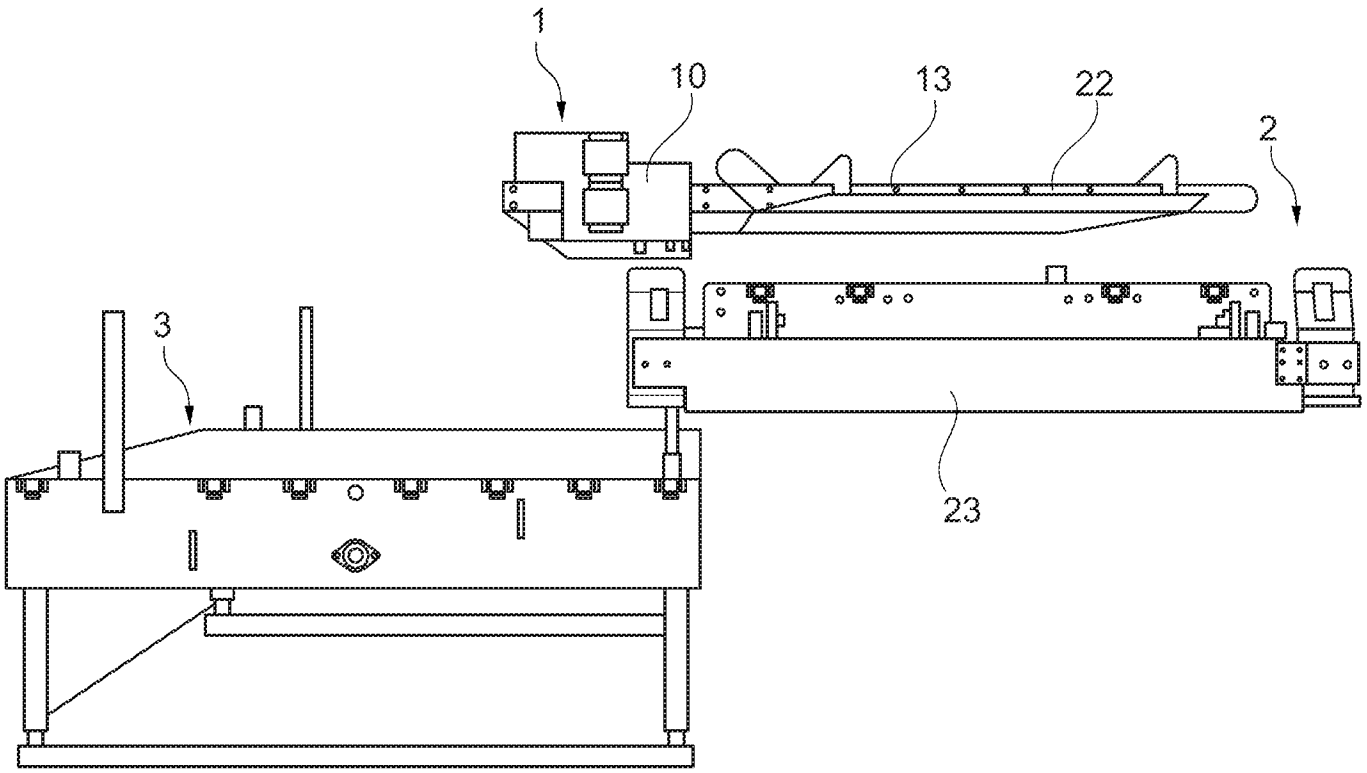
FIG. 9, FIG. 10, FIG. 11, FIG. 12, FIG. 13, FIG. 14, FIG. 15 and FIG. 16 illustrate the kinematics of the separator during various phases of operation.

In the configuration illustrated in FIG. 9, the arms of the support 13 are in the deployed position over the stacking table 2 and, in particular, over the suction device 22.

Figure 10:
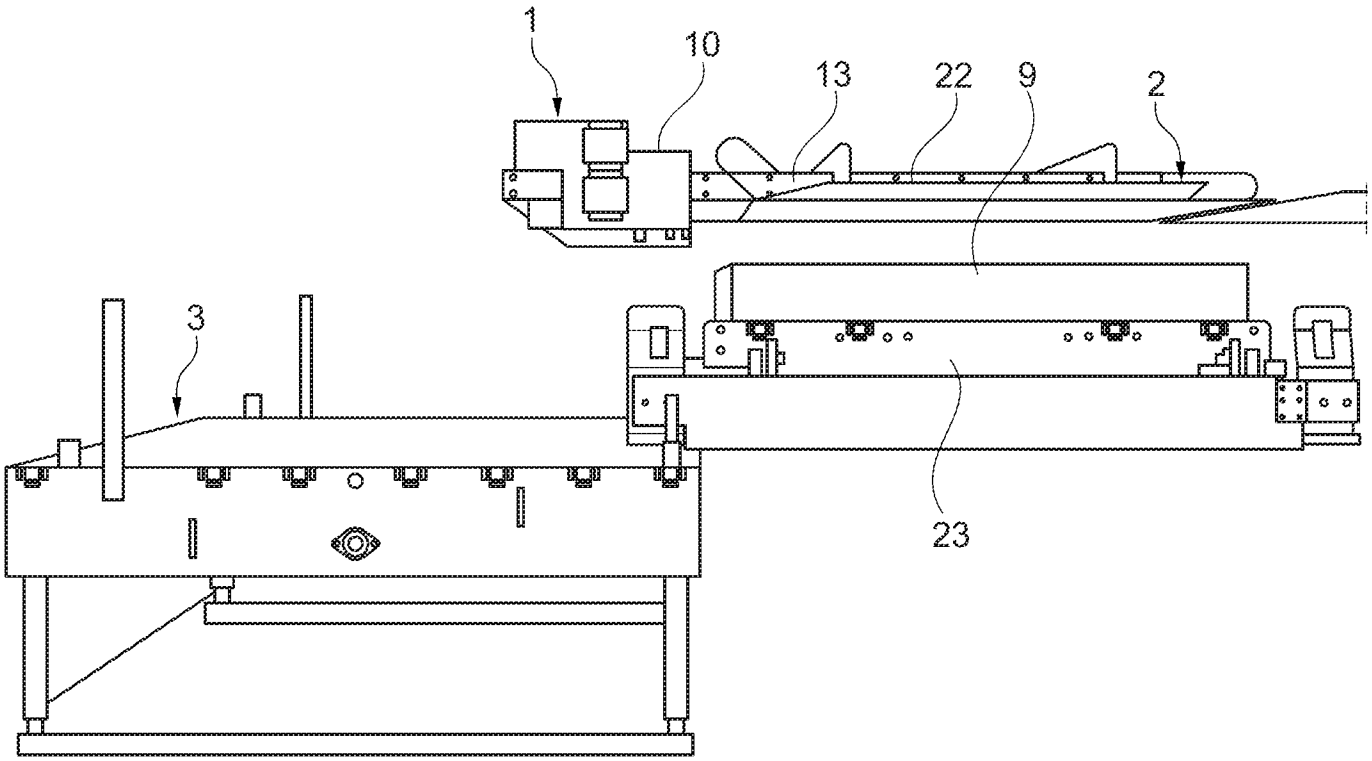

In the configuration illustrated in FIG. 10, the arms 13 are kept in the deployed position over the suction device 22. Sheet elements 9 have been stacked on the endless conveyor belts 20. The support 23 is lowered gradually as the sheet elements 9 stack up.

Figure 11:
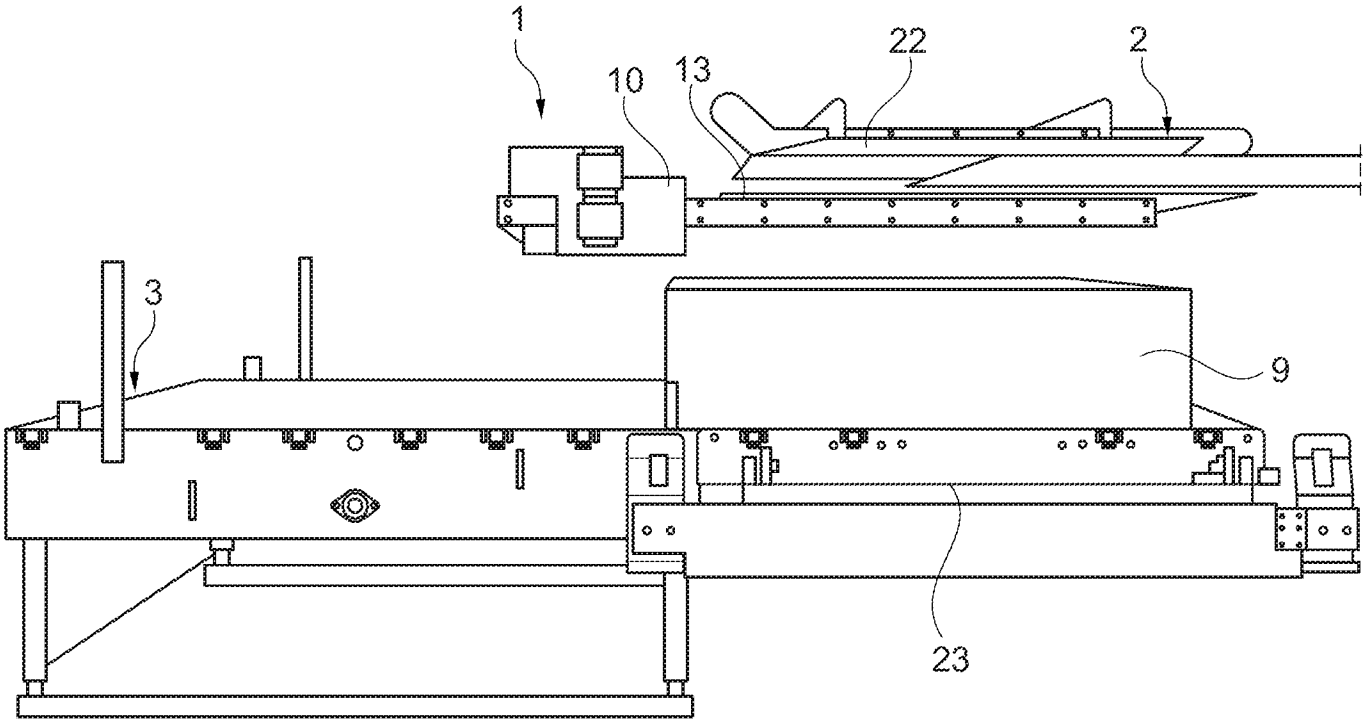

In the configuration illustrated in FIG. 11, the arms 13 have been brought into the retracted position and then the support 10 has been lowered again below the level of the suction device 22. Arms 13 have been deployed under the suction device 22 (for the sake of simplicity, all of the arms have been deployed here) and above the support 23. Arriving sheet elements 9 are therefore stacked on the deployed arms 13 of the separator 1. The sheet elements 9 positioned on the endless conveyor belts 20 can thus be moved away, while the cycle of arrival of new sheet elements 9 continues.

Figure 12:
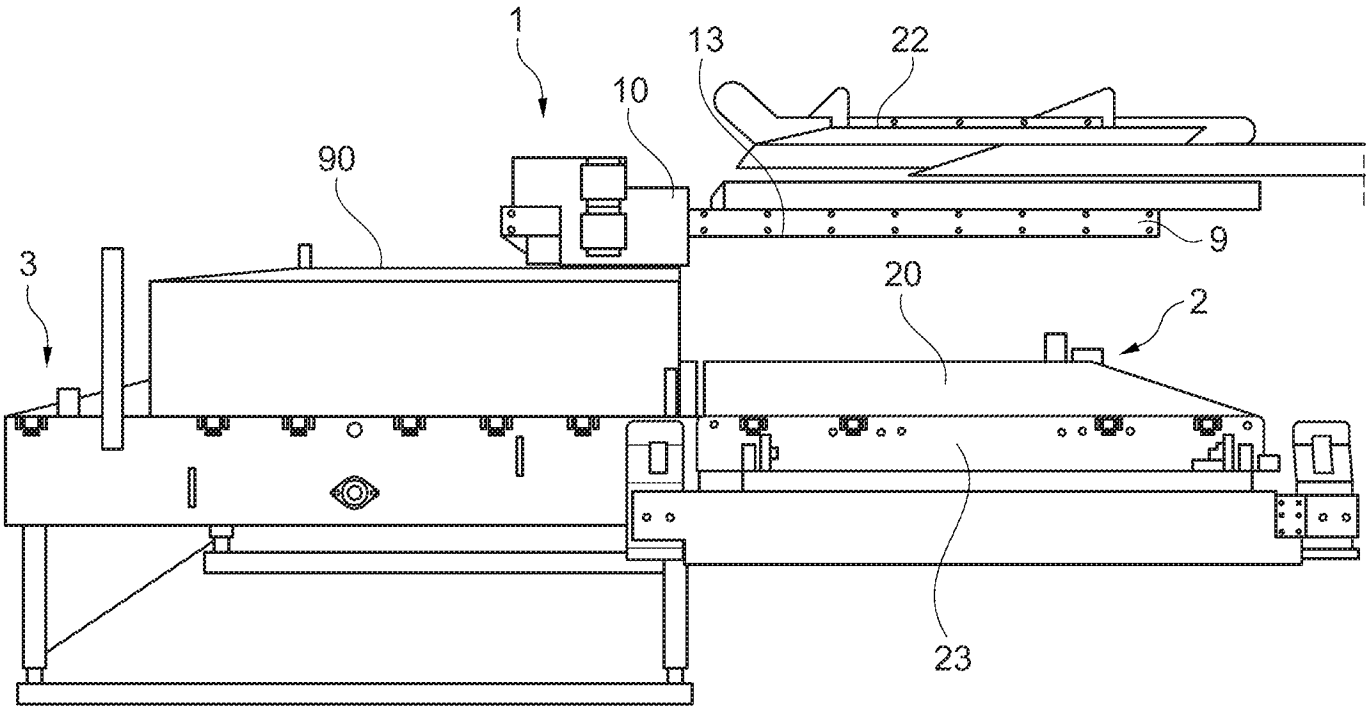

In the configuration illustrated in FIG. 12, a bundle 90 present on the endless conveyor belts 20 is transferred by these belts onto the output conveyor 3. The support 10 descends progressively as the sheet elements 9 stack up on the deployed arms 13.

Figure 13:
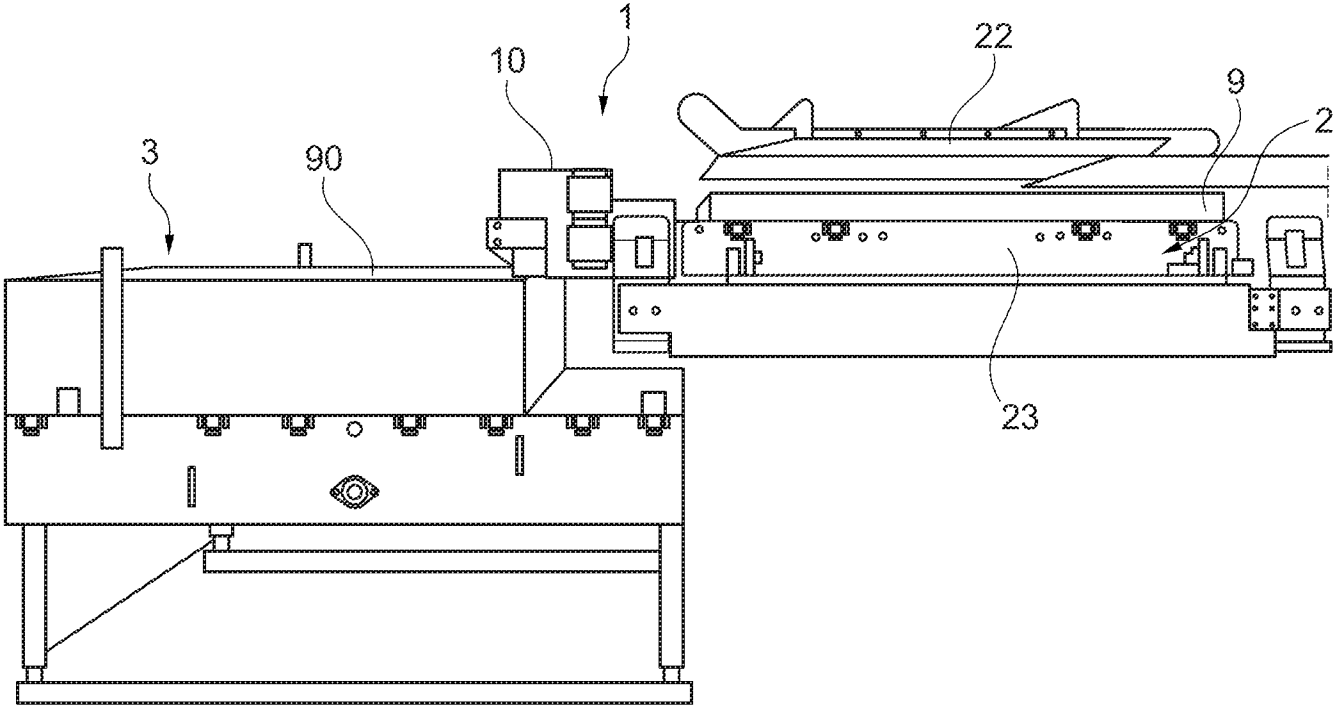

In the configuration illustrated in FIG. 13, the output conveyor 3 discharges the bundle 90. The support 23 therefore rises back up to the level of the arms 13. The endless conveyor belts 20 then interpose themselves between the deployed arms 13 until they come to support the stack of sheet elements 9. The separator 1 has thus made it possible to temporarily receive sheet elements 9, allowing various bundles of elements to be separated and allowing them to be transferred to the output conveyor 3.

Figure 14:
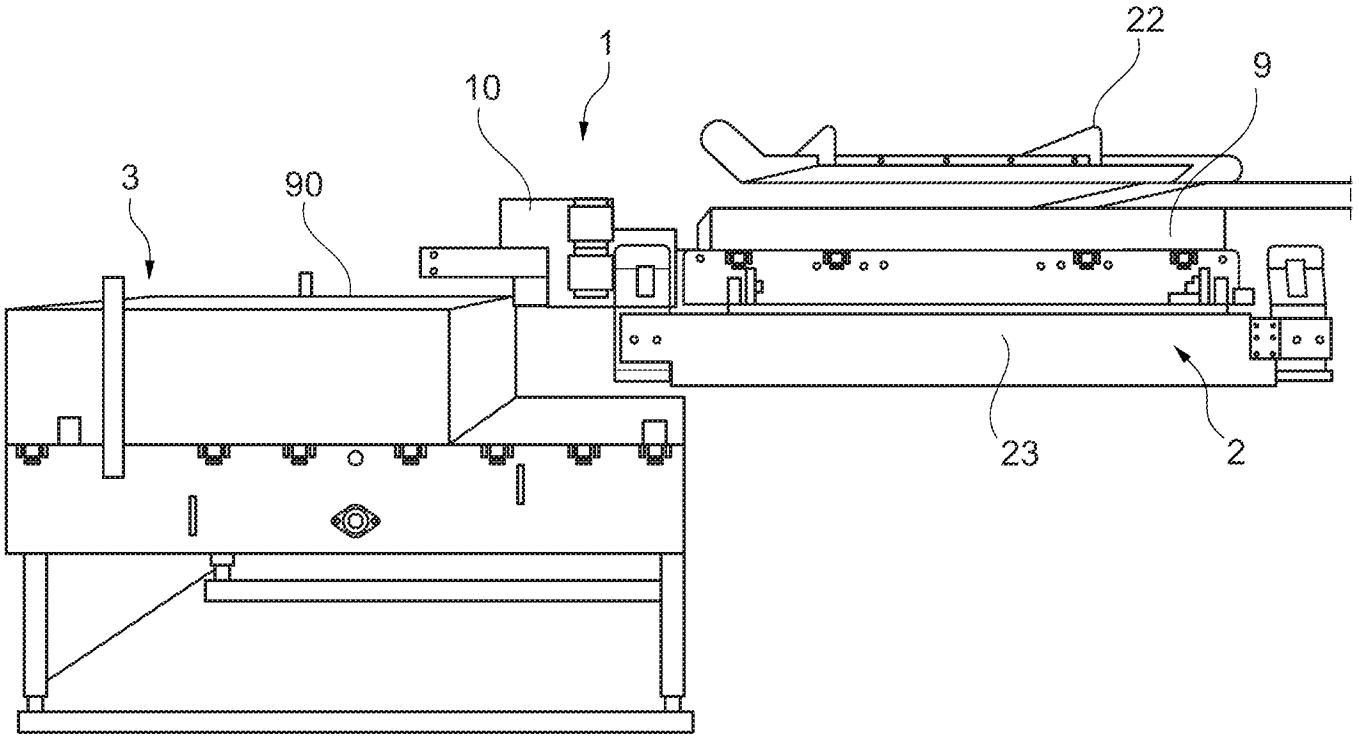

In the configuration illustrated in FIG. 14, the deployed arms 13 are no longer supporting sheet elements 9 which are now being supported by the endless conveyor belts 20. The arms 13 therefore begin to move towards their retracted position.

Figure 15:
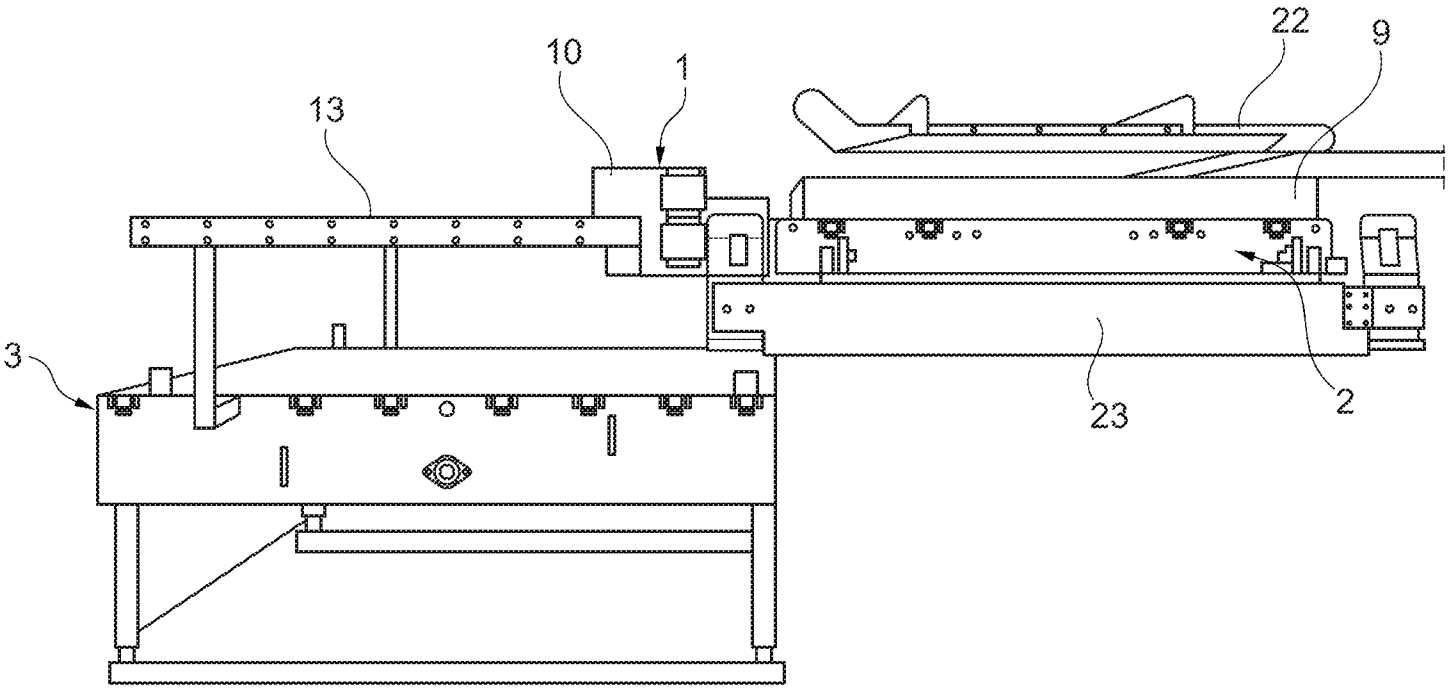

In the configuration illustrated in FIG. 15, the arms 13 have all been moved into their retracted position. None of the arms 13 is therefore overhanging the stacking table 2. The arms 13 are therefore retracted out of the path of the support 23 of the stacking table 2.

Figure 16:
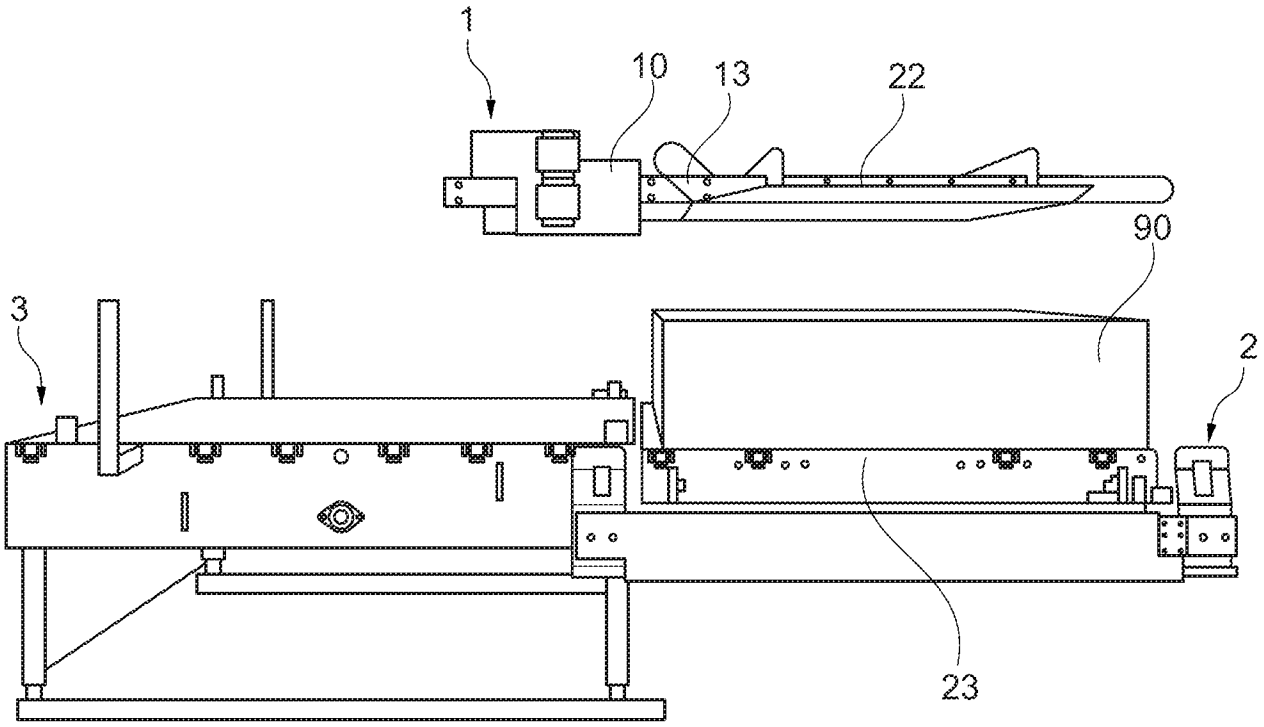

In the configuration illustrated in FIG. 16, the support 10 has been raised to above the suction device 22. The arms 13 have advantageously been moved so that they overhang over the suction device 22, so as not to risk interfering with an operator vertically over the output conveyor 3.

The invention claimed is:

1. A separator for temporarily receiving sheet elements that are to be transferred from a stacking table to an output conveyor of bundles of sheet elements, the separator comprising:

a support mounted and configured to slide in a vertical direction;

a drive device for driving the support in the vertical direction;

a plurality of arms extending in a longitudinal horizontal direction, spaced apart in a transverse direction, at least one arm of the plurality of arms being mounted and configured to move in the longitudinal horizontal direction with respect to the support, a movement of the at least one arm modifying an overhanging length of the at least one arm with respect to the support on a first side in the longitudinal horizontal direction; and a drive system configured to simultaneously move the at least one arm in the longitudinal horizontal direction and to keep another of the plurality of arms in a longitudinal position, the drive system including:

a shaft, the shaft being deployed in the transverse direction and driven in rotation;

a pinion for each arm of the plurality of arms, each pinion for each arm rotating with the shaft;

a rack secured to the plurality of arms; and a clutch-forming device configured to selectively couple and uncouple each pinion for each arm with respect to the rack, wherein the clutch-forming device includes, for each arm, an actuator configured to move a pinion associated with an arm translationally along an axis of the shaft in order to selectively engage or disengage the rack with respect to the arm.

2. The separator of claim 1, wherein each pinion is coupled to the shaft via a key.

3. The separator of claim 1, wherein each arm comprises a slider collaborating with a slideway secured to the support, so as to guide a movement of an arm in the longitudinal horizontal direction.

4. The separator of claim 1, wherein the plurality of arms are arranged at a same vertical level with respect to the support.

5. The separator of claim 1, wherein the plurality of arms are mounted and configured to slide with respect to the support so as to be able to reach to hold a bundle of sheet elements with respect to the support on the first side.

6. The separator of claim 1, wherein the plurality of arms are spaced apart in the transverse direction by a distance corresponding to a separation between endless conveyor belts of the stacking table.

7. The separator of claim 1, further comprising a control unit configured to control, sequentially:

sliding of the support downwards;

moving the plurality of arms into a deployed position with overhang with respect to the first side;

placing all of the plurality of arms in a retracted position with respect to the first side; and sliding of the support upwards.

8. The separator of claim 7, wherein the control unit is further configured to control sliding of the support downward in a succession of sliding steps and stoppages.

9. A station for receiving sheet elements and for discharging bundles of sheet elements for a machine for manufacturing packaging, wherein the station includes a separator as claimed in claim 1.

10. A separator for temporarily receiving sheet elements that are to be transferred from a stacking table to an output conveyor of bundles of sheet elements, the separator comprising:

a support mounted and configured to slide in a vertical direction;

a drive device for driving the support in the vertical direction;

a plurality of arms extending in a longitudinal horizontal direction, spaced apart in a transverse direction, at least one arm of the plurality of arms being mounted and configured to move in the longitudinal horizontal direction with respect to the support, a movement of the at least one arm modifying an overhanging length of the at least one arm with respect to the support on a first side in the longitudinal horizontal direction; and a drive system configured to simultaneously move the at least one arm in the longitudinal horizontal direction and to keep another of the plurality of arms in a longitudinal position, the drive system including:

a shaft, the shaft being deployed in the transverse direction and driven in rotation;

a pinion for each arm of the plurality of arms, each pinion for each arm rotating with the shaft;

a rack secured to the plurality of arms; and a clutch-forming device configured to selectively couple and uncouple each pinion for each arm with respect to the rack, wherein the clutch-forming device includes, for each arm, an actuator configured to move a pinion associated with an arm translationally along an axis of the shaft in order to selectively engage or disengage the rack with respect to the arm, and wherein each actuator drives a corresponding lock bolt to immobilize a translational sliding of the arm during disengagement of the pinion associated with the arm.

11. The separator of claim 10, wherein each arm comprises a slider collaborating with a slideway secured to the support, so as to guide a movement of an arm in the longitudinal horizontal direction.

12. The separator of claim 10, wherein the plurality of arms are arranged at a same vertical level with respect to the support.

13. The separator of claim 10, wherein the plurality of arms are mounted and configured to slide with respect to the support so as to be able to reach to hold a bundle of sheet elements with respect to the support on the first side.

14. A station for receiving sheet elements and for discharging bundles of sheet elements for a machine for manufacturing packaging, wherein the station includes a separator as claimed in claim 10.

15. A separator for temporarily receiving sheet elements that are to be transferred from a stacking table to an output conveyor of bundles of sheet elements, the separator comprising:

a support mounted and configured to slide in a vertical direction;

a drive device for driving the support in the vertical direction;

a plurality of arms extending in a longitudinal horizontal direction, spaced apart in a transverse direction, at least one arm of the plurality of arms being mounted and configured to move in the longitudinal horizontal direction with respect to the support, a movement of the at least one arm modifying an overhanging length of the at least one arm with respect to the support on a first side in the longitudinal horizontal direction; and a drive system configured to simultaneously move the at least one arm in the longitudinal horizontal direction and to keep another of the plurality of arms in a longitudinal position, the drive system including:

a shaft, the shaft being deployed in the transverse direction and driven in rotation;

a pinion for each arm of the plurality of arms, each pinion for each arm rotating with the shaft;

a rack secured to the plurality of arms; and a clutch-forming device configured to selectively couple and uncouple each pinion for each arm with respect to the rack wherein each pinion is coupled to the shaft via a key.

16. The separator of claim 15, further comprising a control unit configured to control, sequentially:

sliding of the support downwards;

moving the plurality of arms into a deployed position with overhang with respect to the first side;

placing all of the plurality of arms in a retracted position with respect to the first side; and sliding of the support upwards.

17. The separator of claim 16, wherein the control unit is further configured to control sliding of the support downward in a succession of sliding steps and stoppages.

18. A station for receiving sheet elements and for discharging bundles of sheet elements for a machine for manufacturing packaging, wherein the station includes a separator as claimed in claim 15.

19. The separator of claim 15, wherein the plurality of arms are arranged at a same vertical level with respect to the support.

20. The separator of claim 15, wherein the plurality of arms are mounted and configured to slide with respect to the support so as to be able to reach to hold a bundle of sheet elements with respect to the support on the first side.

* * * * *